US007051686B2

(12) United States Patent
Shkolnikov et al.

(10) Patent No.: US 7,051,686 B2
(45) Date of Patent: May 30, 2006

(54) VARIABLE VOLUME VALVE FOR A COMBUSTION POWERED TOOL

(75) Inventors: Yury Shkolnikov, Glenview, IL (US); Tony Deieso, Wadsworth, IL (US); Walter J. Taylor, McHenry, IL (US)

(73) Assignee: Illinios Tool Works Inc., Glenview, IL (US)

( * ) Notice: Subject to any disclaimer, the term of this patent is extended or adjusted under 35 U.S.C. 154(b) by 798 days.

(21) Appl. No.: 09/973,103

(22) Filed: Oct. 9, 2001

(65) Prior Publication Data

US 2002/0117128 A1 Aug. 29, 2002

Related U.S. Application Data

(63) Continuation-in-part of application No. 09/849,606, filed on May 4, 2001, now Pat. No. 6,655,570.

(51) Int. Cl.
*F02B 71/00* (2006.01)

(52) U.S. Cl. ..... 123/46 SC; 277/8; 277/10

(58) Field of Classification Search ..... 123/46 SC; 277/8, 9, 10, 130
See application file for complete search history.

(56) References Cited

U.S. PATENT DOCUMENTS

| | | | | |
|---|---|---|---|---|
| 517,589 | A | | 4/1894 | Reichmann |
| 560,550 | A | | 5/1896 | Smith |
| 655,996 | A | | 8/1900 | Rylands |
| 926,142 | A | | 6/1909 | Schodde |
| 1,293,858 | A | | 2/1919 | Mills |
| 2,380,745 | A | | 7/1945 | Frantz |
| 2,504,569 | A | | 4/1950 | Murphy et al. |
| 2,671,433 | A | | 3/1954 | Meddock |
| 3,938,543 | A | * | 2/1976 | Sorenson ..... 137/312 |
| 4,218,888 | A | | 8/1980 | Jayne |
| 4,377,991 | A | | 3/1983 | Liesse |
| 4,449,507 | A | * | 5/1984 | Mayer ..... 123/467 |
| 4,621,496 | A | * | 11/1986 | Lamb ..... 60/479 |
| 4,717,060 | A | | 1/1988 | Cotta |
| 4,721,240 | A | | 1/1988 | Cotta |
| 4,913,331 | A | | 4/1990 | Utsumi et al. |
| 5,090,606 | A | | 2/1992 | Torii et al. |
| 5,191,861 | A | | 3/1993 | Kellerman et al. |

(Continued)

FOREIGN PATENT DOCUMENTS

| | | |
|---|---|---|
| AU | 17310-02 | 12/1992 |

(Continued)

*Primary Examiner*—John T. Kwon
(74) *Attorney, Agent, or Firm*—Lisa M. Soltis; Mark W. Croll; Greer, Burns & Crain, Ltd.

(57) ABSTRACT

A variable volume metering chamber and valve assembly for a combustion-powered tool includes a housing defining a metering chamber having an internal volume and including an inlet and an outlet, and a plunger configured for reciprocal movement relative to the chamber for adjusting the internal volume of the metering chamber. The plunger is preferably adjustable by the user to alter the volume of fuel retained in the metering chamber. In the housing, a first valve controls control fluid flow through the inlet, a second valve controls fluid flow through the outlet, and an actuator assembly, connected to the valves, is sequentially operable from a first position, in which the first valve is open and the second valve is closed, to a second position, in which the first and second valves are both closed, and a third position, in which the first valve is closed and the second valve is open.

13 Claims, 5 Drawing Sheets

U.S. PATENT DOCUMENTS 5,197,646 A 3/1993 Nikolich
5,213,247 A 5/1993 Gschwend et al.
5,390,851 A * 2/1995 Long et al. ..... 239/88
5,460,133 A * 10/1995 Perr et al. ..... 123/446
5,619,969 A * 4/1997 Liu et al. ..... 123/447
5,680,980 A 10/1997 Robinson
5,752,643 A 5/1998 MacVicar et al.
5,860,580 A 1/1999 Velan et al.
5,873,508 A 2/1999 MacVicar et al.
5,909,836 A 6/1999 Shkolnikov et al.
5,954,029 A * 9/1999 Peters et al. ..... 123/446
5,971,245 A 10/1999 Robinson
6,006,704 A 12/1999 Phillips et al.
6,016,946 A 1/2000 Phillips et al.
6,158,643 A 12/2000 Phillips
6,655,570 B1 * 12/2003 Shkolnikov et al. ..... 227/10
2002/0162521 A1 * 11/2002 Shkolnikov et al. ..... 123/46 R
2004/0187810 A1 * 9/2004 Gschwend et al. ..... 123/46 H

FOREIGN PATENT DOCUMENTS

GB 2 067 516 7/1981
WO 00/55072 9/2000
WO 01/07766 1/2001

* cited by examiner

VARIABLE VOLUME VALVE FOR A COMBUSTION POWERED TOOL

RELATED APPLICATION

This application is a continuation-in-part of U.S. Ser. No. 09/849,706 filed May 4, 2001 for CONSTANT VOLUME VALVE FOR A COMBUSTION POWERED TOOL now U.S. Pat. No. 6,655,570.

BACKGROUND OF THE INVENTION

The present invention relates to a constant volume valve for a combustion-powered tool, such as a power framing tool. More specifically, it relates to a constant volume valve assembly that measures a volume of a fluid before allowing it to flow into a combustion chamber.

This invention also relates to a pneumatically powered, combustion-powered, or other rapidly acting, fastener-driving tool of a type utilizing collated fasteners. Typically, as exemplified in Nikolich U.S. Pat. Re. 32,452, Nikolich U.S. Pat. No. 4,522,162; Nikolich U.S. Pat. No. 4,483,474; Nikolich U.S. Pat. No. 4,403,722 and Wagdy U.S. Pat. No. 4,483,473, which are herein incorporated by reference, a combustion-powered, fastener-driving tool comprises a combustion chamber, which is defined by a cylinder body and by a valve sleeve arranged for opening and closing the combustion chamber. Generally, similar combustion-powered, nail- and staple-driving tools are available commercially from ITW-Paslode (a unit of Illinois Tool Works Inc.) of Vernon Hills, Ill., under its IMPULSE trademark.

In such a tool, it is beneficial to apply a constant force during the driving stroke to each fastener as it is driven into the workpiece. Measurement of the amount of fuel to the combustion-powered tool, or the amount of compressed gas to a pneumatically powered tool, helps provide a constant force. A combustion powered fastening tool is described in U.S. Pat. No. 4,721,240 to Cotta that measures fuel by opening a valve for a length of time defined by movement of a cam. Fuel passes through a fuel valve to a combustion chamber conduit, the amount of which is equal to the volume that passes through a needle valve during the time the fuel valve is open. Measurement of the flow of a fluid by time allows the amount of fluid supplied to the tool to vary as flow rates of the fluid change. As a fuel cylinder is emptied, the flow rate of the fluid changes as the cylinder pressure drops. Similarly, pressure or flow variations in a common supply of pneumatic fluid will also result in differences in the amount of power supplied on each charge of the cylinder.

Control of fuel into a combustion chamber by valve assemblies is shown in U.S. Pat. Nos. 655,996 and 1,293,858. Both references disclose a pressurized fluid inlet valve and fluid outlet valve that bracket a machine-supply passage. High-pressure fluid is fed to a machine to supply power via the inlet valve, and is discharged through the outlet valve when it returns from the machine following expulsion of its power. Neither reference teaches the use of such a system to supply a constant measurement of fluid. Further, following combustion of a fuel or expansion of a high-pressure fluid, the fluid is no longer useful to supply power to a tool and measurement at that point is ineffective.

U.S. Pat. No. 4,913,331 to Utsumi describes an apparatus that drives a piston with an internal combustion engine that utilizes a measuring chamber to dispense a constant volume of fuel. A fuel piston containing the measuring chamber is reciprocally moveable within a fuel cylinder. The fuel inlet channel and the fuel outlet channel are positioned such that the measuring chamber is filled and emptied by movement of the piston between the inlet and outlet channels. Seals are located on either side of the chamber between the fuel piston and the cylinder, preventing leakage of fuel from the pressurized fuel supply to the combustion chamber. Steady movement of the piston would cause rapid wear on these seals, since they are constantly in contact with the cylinder surface.

One operational drawback of conventional combustion-powered tools, is that when operated at relatively low temperatures, such as below 32° F., the pressure of the pressurized fuel falls, causing a greater pressure differential between the atmosphere and the fuel. At this lower pressure, the fuel does not dissipate as rapidly through the appropriate passageways and into the combustion chamber. This condition causes a delay in the combustion, which interferes with the operational efficiency of the tool.

Another operational drawback of conventional combustion-powered tools, is that when operated at relatively higher elevations or altitudes, there is less air for combustion. As a result, when used at such higher elevations, conventional combustion-powered tools with constant volume fuel metering valves can have overly rich fuel/air mixtures in their combustion chambers, which can lead to fouling of the ignition system as well as other operational difficulties. As such, there is a need for a combustion-powered tool with a fuel metering valve which has the capability of adjusting the amount of fuel in the combustible fuel/air mixture.

It is, therefore, an object of this invention to provide an improved constant volume measurement of a fluid to an apparatus, such as a combustion-powered tool, to produce a constant driving force.

It is yet another object of this invention to provide an improved constant volume measurement of fluid in a compact space.

It is still another object of this invention to provide an improved constant volume valve assembly, whose seals are not constantly wearing against a sealing surface.

It is a further object of the present invention to provide an improved constant volume valve assembly that facilitates the movement of fuel even when fuel pressure drops, such as when the tool is exposed to low temperatures.

It is a still further object of the present invention to provide an improved constant volume valve assembly that provides the capability of adjusting the fuel mixture, such as when the tool is operated at relatively high elevations.

SUMMARY OF THE INVENTION

These and other objects are met or exceeded by the present device for metering a constant volume of fluid to provide constant energy to a tool. This apparatus is most useful in a portable fastening tool powered either pneumatically or by an internal combustion engine. In the preferred embodiment, configuration of the valves and control mechanism also provides a delay between the closing of one valve and the opening of another, ensuring that fluid is metered before moving downstream to the combustion chamber.

More specifically, the present invention provides a variable volume metering chamber and valve assembly for a combustion-powered tool including a housing defining a metering chamber having an internal volume and including an inlet and an outlet, and a plunger configured for reciprocal movement relative to the chamber for adjusting the internal volume of the metering chamber. The plunger is preferably adjustable by the user to alter the volume of fuel retained in the metering chamber. In the housing, a first valve controls control fluid flow through the inlet, a second valve controls fluid flow through the outlet, and an actuator assembly, connected to the valves, is sequentially operable from a first position, in which the first valve is open and the second valve is closed, to a second position, in which the first and second valve are both closed, and a third position, in which the first valve is closed and the second valve is open.

The present metering valve also produces a constant driving force by a fastener-driving tool because it provides a consistent quantity and quality of fuel or hydraulic fluid each time the tool is fired. The fluid supply to the power tool of this invention is measured by volume, not by time, providing a more accurate and more consistent supply of power to the tool. As pressure varies, the fluid density changes in either system because the molecules become more or less densely packed. However, in a flow system, flow rates will also change if the pressure drop across the metering valve fluctuates. Change in flow rate will have no efeect in a constant volume system as long as the constant volume chamber is filled in the time the inlet valve to the metering chamber is open.

Further, arrangement of the metering chamber and the spring-biased valves in the present invention leads to compact use of space, as would be useful in a compact, portable tool. Collinear placement of the valves and the oblique angle of the combustion chamber passageway features a shorter distance from the pressurized fluid supply to the combustion chamber, compared to other designs.

Using spring-biased valves to control fluid flow is also advantageous. The seat of the valve that forms the seal with the inlet and outlet of the metering chamber is in contact with the walls of the chamber only for a relatively short time. As the valves open and close, there is no constant rubbing of the seals with adjacent walls. This leads to longer life for the seals.

Another advantage of the present valve assembly is that a disk is preferably provided to at least one of the spring-biased valves which facilitates the flow of fuel into a combustion chamber passageway even in operational conditions when fuel flow is impaired, as when outside operational temperatures fall below freezing.

Still another feature of the present valve assembly is that the actuator assembly is configured to provide an inherent delay in the operation of the upper and lower spring-biased valves to ensure that a designated volume of fuel will be retained in the metering chamber before the lower valve releases the fuel to the combustion chamber. In the preferred embodiment, this delay is achieved in part by a deliberately loose mating engagement between a tongue of an actuator pivoting link arm and a notch in an actuator control arm. This loose engagement ensures that, while the pivoting link arm travels a continuous motion due to the engagement of the tool upon a workpiece, the actuator control arm is not continuously moved, resulting in a slight "pause" in the operation of the spring-biased valves. In this manner, the consistency of the volume of fuel temporarily held in the metering chamber is maintained.

Yet another feature of the present valve assembly is that the valve features an adjustment for changing the amount of fuel passed to the combustion chamber in each firing cycle. This is accomplished in the preferred embodiment by providing an adjustable shaft which can be threadably advanced by the user into the fuel metering chamber to reduce the volume of the chamber, and thus reduce the space available for incoming fuel. Thus, as more fuel or a richer mixture is desired, the shaft is backed off away from the fuel metering chamber to increase the chamber volume. A leaner fuel mixture is obtained by advancing the shaft into the fuel metering chamber.

A still further feature of the present valve assembly is that the adjustable shaft described above can be replaced by an electric heating element for use when the tool is used in colder conditions of the type which induce lower fuel pressure. The heating element heats either the fuel metering chamber itself or the surrounding portion of the valve housing.

DETAILED DESCRIPTION OF THE INVENTION

Figure 1:
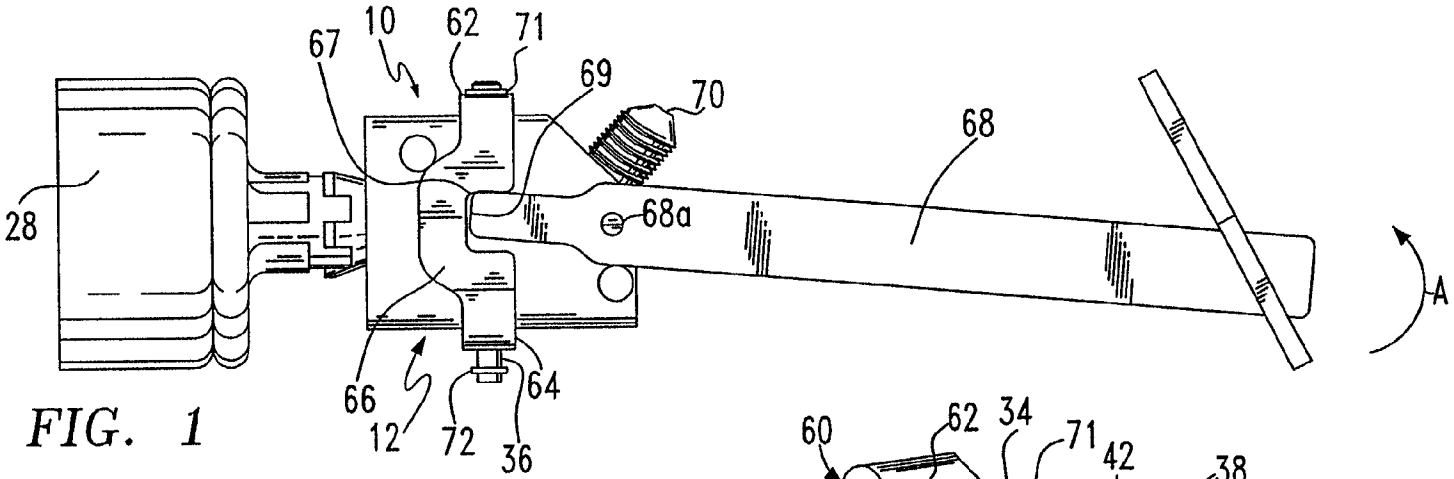
FIG. 1 is a back view of the present constant volume valve assembly as attached to a fuel canister.
Figure 2:
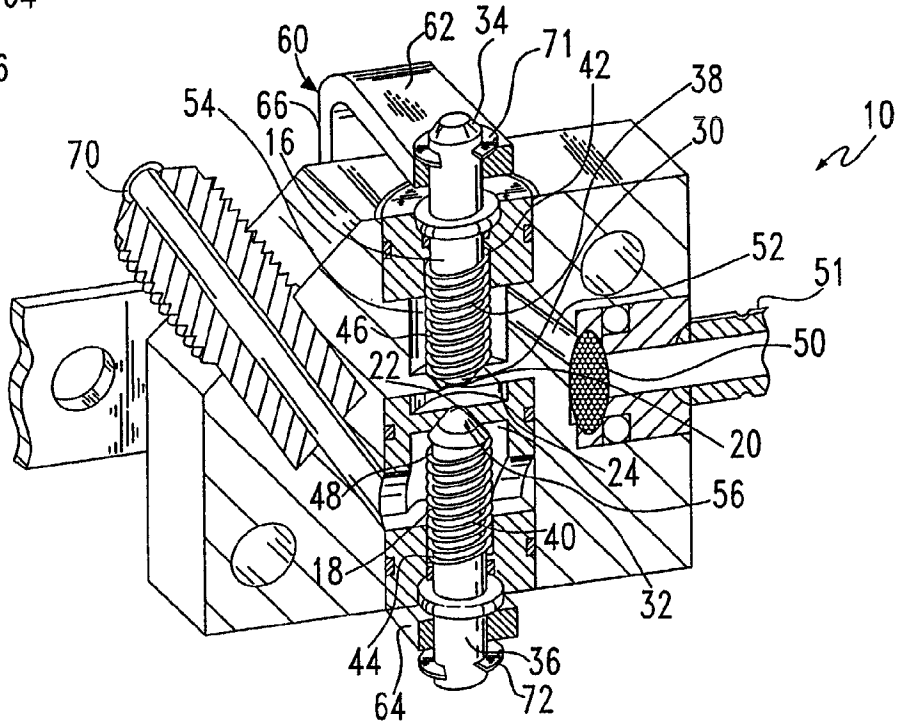
FIG. 2 is a front vertical sectional view of the present constant volume valve assembly.

Referring to FIGS. 1 and 2, a constant volume valve assembly and metering chamber is, generally designated 10. In the following description, the terms "upper" and "lower" refer to the assembly in the orientation shown in the drawings. However, it is contemplated that the present assembly may be used in a variety of positions as is well known in the art. The present valve assembly 10 is particularly useful in a pneumatic or combustion powered tool (not shown), having a valve housing 12 in which the fluid to be metered is injected under pressure. The valve assembly 10 provides a fixed amount of fuel to the combustion chamber (not shown) of the tool. Alternatively, it is contemplated that the present valve assembly 10 may also meter pressurized air, which expands to provide power, to the pneumatic tool. The present valve assembly 10 is usable in any tool or device that would benefit from a steady, uniform supply of a pressurized fluid.

The housing 12 of the valve assembly 10 includes at least two spring-biased valves, a first spring-biased valve 16 and a second spring-biased valve 18 that respectively control the fluid flow to an inlet 20 and an outlet 22 of a metering chamber 24. The metering chamber 24 is defined by the housing 12, and optionally has one or more ports in addition to the inlet 20 and outlet 22, as will be discussed below. Neither the shape of the metering chamber 24, nor the position of the inlet 20 or outlet 22 is particularly important.

However, it is preferable to place the inlet 20 and the outlet 22 at diametrically opposed ends of the metering chamber 24. In this configuration, the spring-biased valves 16, 18 are preferably approximately axially collinear, conserving space. In this preferred configuration, fluid flow through the metering chamber 24 will flow from the inlet 20 to the outlet 22, generally parallel to the axes of the spring-biased valves 16, 18.

The metering chamber 24 may be any type of chamber capable of providing a constant volume space for measurement of the fluid, meaning that the volume of fluid collected in the metering chamber is equal to the volume of fluid released from the metering chamber. While the fluid is sealed within the metering chamber 24, the pressure remains constant. The metering chamber 24 may be a separate vessel or it may simply be a cavity 24 within the housing 12. The housing 12 will generally also be used to support other components of the propulsion system, such as a pressurized fluid canister 28 (shown in FIG. 1) and the spring-biased valves 16, 18. Preferably, the metering chamber 24 is stationary relative to the housing 12.

The volume of the metering chamber 24 while preferably fixed, is optionally adjustable by, for example, placement of a movable wall or opening of valves to additional chambers (not shown). However, its usefulness for metering purposes depends upon the ability of the chamber 24 to remain at a constant volume until some setting, valve or adjustment is purposely changed.

The spring-biased valves, 16, 18 each include a preferably conical seat 30, 32, a rod 34, 36, and a spring 38, 40, respectively. Although discussed in terms of the first spring-biased valve 16, it is to be understood that the following description also applies to the corresponding parts of the second spring-biased valve 18. The seat 30 is sized and configured to sealingly engage with the inlet 20 of the metering chamber 24 when the spring-biased valve 16 is in a closed position. Movement of the seat 30 between an open position and the closed position, is controlled by the rod 34. Although the spring 38 is an economical method of biasing the valve, use of other biasing devices is contemplated. The spring 38 is used to bias the valve 16 toward the closed position. Each of the springs 38, 40 has an anchored end 42, 44 and a movable end 46, 48, respectively. The movable end 46 exerts a force against the seat 30 tending to move it in the direction of the metering chamber 24 by the force of the spring 38 pushing against the anchored end 42. Although the anchored end 42 may be anchored directly to the housing 12, preferably, the anchored end is seated within a compartment described in greater detail below.

Fluid is supplied to the housing 12 under pressure. It is generally desirable that the tool is portable, and in such a case, the fluid is delivered from the pressurized canister 28 that fits within or attaches to the tool. In the case where the tool is to be used in a shop or other location where a large supply of pressurized fluid is available, the fluid is preferably available to the tool through a hose or similar device (not shown). The valve assembly 10 of the present invention is useful in either of these situations, and use in either setting is contemplated. Since temperature and pressure affects the density of any fluid, these factors should be kept as constant as possible to minimize variation in the amount of fluid supplied.

Before entering the valve assembly 10, the fluid preferably flows through a filter 50 (FIG. 2) to minimize unwanted contaminants. The filter 50 is preferably disposed at one end of a nipple 51, which matingly and sealingly engages the canister 28. After passing the filter 50, the fuel travels into an upper passageway 52. The upper passageway 52 leads from the source of the pressurized fluid, such as the pressurized canister 28, to the inlet 20 of the metering chamber 24. To achieve the most consistent amount of fluid, the upper passageway 52 is preferably sufficiently wide to consistently achieve supply pressure before closure of the first spring-biased valve 16.

In some cases, it is desirable to provide an upper chamber 54 for accumulation of pressurized fluid. Where, for example, the flow rate of the fluid is low, fluid accumulates in the upper chamber 54, providing a burst of fluid to enter the metering chamber 24 when the inlet 20 is opened. Fluid released from the metering chamber 24 flows into a lower chamber 56. Metering is accomplished through opening and closing of the first and second spring-biased valves 16, 18 by an actuator assembly 60. The actuator assembly 60 is any mechanism capable of causing the opening and closing of the first and second spring-biased valves 16, 18 in a particular sequence to allow measurement of the fluid in the metering chamber 24. While a mechanical linkage is the preferred form of the actuator assembly 60, a computer controlling one or more cams is an example of an acceptable alternative configuration.

In the preferred embodiment, the actuator assembly 60 includes a C-shaped actuator arm with an upper arm 62, which is connected to the rod 34 of the first spring-biased valve 16, and a lower arm 64, which is connected to the rod 36 of the second spring-biased valve 18. The upper arm 62 and the lower arm 64 are connected to each other by a control arm 66 (FIG. 1). A notch 67 in the control arm 66 is engaged by a pivoting link arm 68 which is pivotally engaged to the housing 12 at a point 68a. The specific engagement between the link arm 68 and the notch 67 is via a tongue 69. The control link arm 68 is operated through movement of the nosepiece valve linkage (not shown), the construction and operation of which is disclosed in the Nikolich patents incorporated by reference here.

An important feature of the present actuator assembly 60 is that a delay is created in the movement of the control arms 62, 64, 66 and their actuation of the upper and lower spring-biased valves 16, 18 so that a constant volume of pressurized fluid is momentarily retained in the metering chamber 24. This delay is created in part by a loose mating engagement between the tongue 69 and the notch 67. In the preferred embodiment, the tongue 69 is provided with a reduced area compared to the notch 67, so that the control link arm 68 can move slightly along its arcuate travel path without causing movement of the control arms 62, 64, and 66. The looseness or "sloppiness" of the engagement between the tongue 69 and the notch 67 can vary with the application, as can the specific configuration of the mating engagement, including having the notch on the arm and the tongue on the control arm 66.

The actuator assembly 60 moves the first and second spring-biased valves 16, 18 in either a first valve sequence or a second valve sequence, depending on which valve is to be opened and which valve is to be closed. The valve sequence is determined according to the combustion cycle, in the case of a combustion tool, or the impact cycle of a pneumatic tool.

Figure 3C:
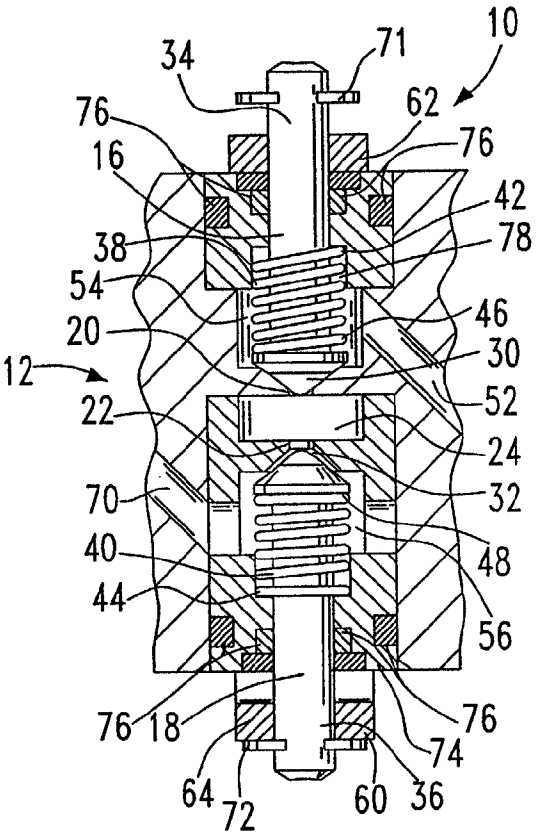
FIGS. 3A–3C are a series of fragmentary sectional views of the present constant volume valve assembly depicting three valve positions as the actuator assembly moves through an operational sequence.
Figure 3B:
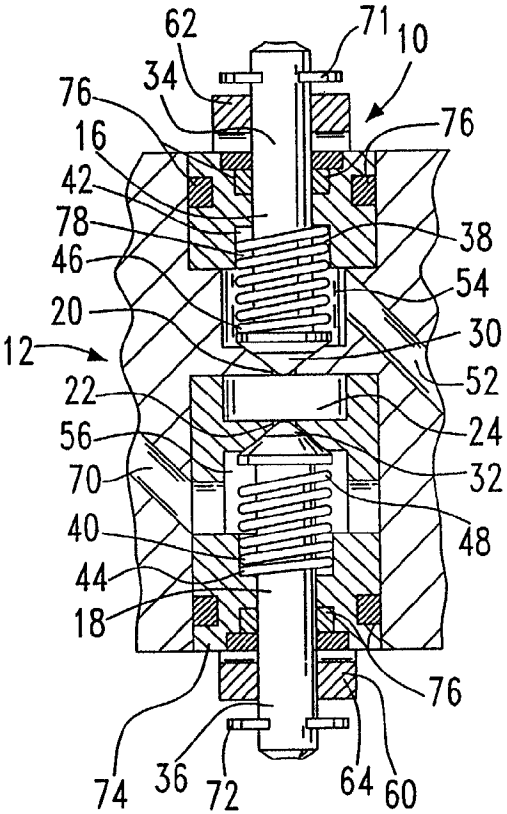
Figure 3A:
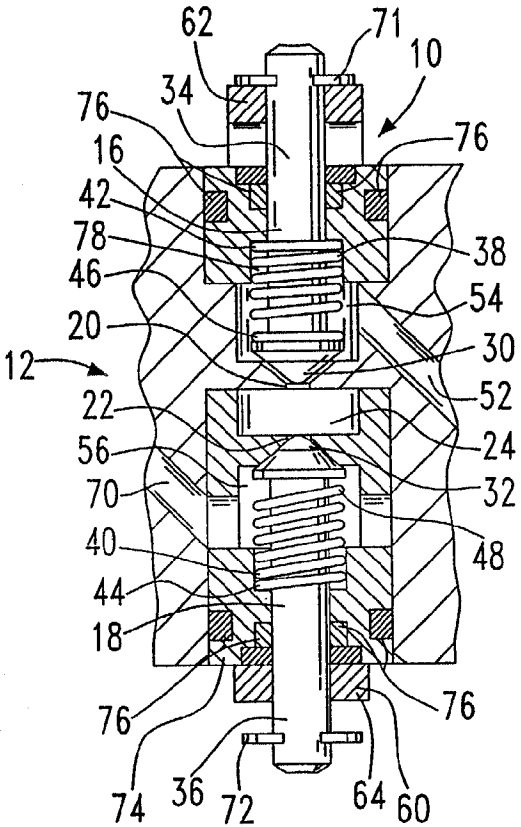

Turning now to FIGS. 3A–3C, the valve sequences are described. The beginning of the first valve sequence is defined when the tool is in between uses. In this position, the tool is powered up and ready to be used, but is not yet in contact with the workpiece into which a fastener is to be driven. At this time, the actuator assembly 60 is in the first position as depicted in FIG. 3A, the arm 62 is spaced a maximum distance from an opposing wall of the housing 12. The first spring-biased valve 16 is in an open position and the second spring-biased valve 18 is closed. The metering chamber 24 is thus filled with fuel or fluid due to communication with the cartridge 28 through the passageway 52.

During the first valve sequence, the first spring-biased valve 16 moves from an open position to a closed position and the second spring-biased valve 18 opens, but the second valve does not begin to open until first valve is completely closed. This first valve sequence will generally be triggered by some stimulus in preparation for firing of the tool. To have power to drive a fastener, the metered fluid is moved into position to deliver that power; i.e., fuel is moved into the combustion chamber or air into an expanding cylinder. The sequence is preferably initiated by any preparatory mechanism, such as contact of the tool with a workpiece, beginning to squeeze the trigger mechanism and the like. If a combustion powered framing tool is used, priming of the combustion chamber preferably takes place when a workpiece contact element comes in contact with the workpiece, allowing the fuel to flow from the metering chamber 24, through the lower chamber 56, into a combustion chamber passageway 70 and ultimately to the combustion chamber (not shown). In the depicted and preferred embodiment, the sequence is initiated by contacting the tool with a workpiece, which causes the pivoting link arm 68 to begin its arcuate path of travel represented by the arrow A (FIG. 1).

It is important to note that the metering chamber 24 is used solely for measurement of the fluid, and that there are no physical or chemical changes to the fluid while it is sealed in the chamber. To provide constant power, the fluid is preferably delivered at the same volume, temperature and pressure for each cycle. Fluids cannot be accurately measured while chemical or physical reactions are taking place, thus it is preferred that the fluid have the same chemical composition when it is released from the metering chamber 24 as when it entered the metering chamber.

Referring now to FIG. 3A, which corresponds to the first position in the preferred embodiment shown, in this position, fluid freely enters the metering chamber 24. As the pivoting link arm 68 moves in an arc defined by the arrow A (FIG. 1), the tongue 67 moves in a reverse arcuate direction. As such, the former upward pressure exerted upon the first rod 34 by the upper arm 62 is released, allowing the spring 38 to bias the first seat 30 of the first valve 16 into engagement with the inlet 20 of the metering chamber 24.

At this point, both spring-biased valves 16, 18 are closed, preventing flow of the fluid from the fluid supply canister 28 into and out of the metering chamber 24. This position is depicted in FIG. 3B, and corresponds to the second position of the actuator assembly 60. The metering chamber 24 is closed at both the inlet 20 and the outlet 22, sealing the fluid within it and providing a measured volume of fluid within the chamber.

The loose mating engagement between the tongue 69 and the notch 67 described above results in a temporary delay in the opening of the second valve 18 while the pivoting link arm 68 continues its arcuate path defined by the arrow A (FIG. 1). Due to the loose engagement, as the pivoting link arm 68 moves, there is a delay while the upward bias opening the first valve 16 is released, and the control arm 66 has not been moved sufficiently to open the second valve 18. This delay ensures that the volume of fuel in the metering chamber 24 will remain constant, and that unwanted additional amounts cannot enter the chamber, or that premature leakage from the outlet 22 into the lower chamber 56 cannot occur.

The third position of the actuator assembly 60 is shown in FIG. 3C, which is attained after the first valve 16 has completely closed and the second spring-biased valve 18 is opened. In this position, the fluid is released from the metering chamber 24. In the preferred embodiment, the entire first valve sequence takes place as the actuator arm 60 moves continuously from the first position through the second position to the third position.

Following firing of the tool 12, the second valve sequence is initiated, in which the lifting of the tool from the workpiece causes the pivoting linking arm 68 to move the actuator assembly 60 from the third position, through the second position, to the first position. This sequence closes off the outlet 22 of the metering chamber 24 from flow downstream, and reopens the inlet 20 to again allow flow of fluid into the metering chamber 24. Any stimulus that follows firing of the tool 12 but precedes the first valve sequence may be used to start this sequence.

The second valve sequence moves the first and second spring-biased valves through the same steps as the first valve sequence, but in the reverse order. Starting with the third actuator assembly 60 position shown in FIG. 3C, the second spring-biased valve 18 is disengaged from the outlet 22, preventing flow of the fluid from the metering chamber 24. After the second valve 18 is completely closed, the second actuator assembly 60 position is obtained, as shown in FIG. 3B. Here both valves 16, 18 are closed to prevent backflow of the fluid, and the metering chamber 24 contains only a residual amount of fluid. Finally, the first spring-biased valve 16 is disengaged from the inlet 20, allowing free flow of the fluid from the fluid supply 28 into the metering chamber 24, but that fluid is prevented from flowing freely from the pressurized fluid supply 28 through the inlet 20 and the outlet 22 of the metering chamber 24 to the combustion chamber passageway 70.

In the preferred embodiment, this operation or valve sequence is controlled by the pivoting action of the link arm 68 which moves the actuator assembly 60 from a position where the upper arm 62 has a maximum spacing from the housing 12 (FIG. 3A), to a position where the lower arm 64 has a maximum spacing from the housing 12 (FIG. 3C). In the preferred embodiment, in addition to the loose mating engagement between the notch 67 and the tongue 69; the actuator assembly 60 also includes a delay mechanism also operating between the closing of one of the valves 16, 18 and the closing of the other valve 18, 16. Any type of delay mechanism is suitable, such as an electrical delay, electronic means for a mechanical delay mechanism. In the most preferred mechanical delay mechanism, the actuator assembly 60 is slidably connected to each of the rods 34, 36. The first rod 34 has a first opener 71 such as a 'C'-clip secured to the rod and the second rod 36 has a second opener 72. Spacing of the openers 71, 72 on the rods 34, 36 are preferably used to create a delay in the closing of one valve 16, 18 before the opening of the other valve 18, 16.

In the preferred delaying mechanism, the control arm 66 of the actuator assembly 60 is longer than the housing 12 in which the valve assembly 10 resides. The excess length is sufficient to allow the upper arm 62 and the lower arm 64 to sandwich the housing 12 between them with excess space between the housing, and the actuator arms 62, 64. In response to the stimulus that triggers the valve sequences, the control arm 66 moves up and down (directions relate to the tool, as oriented in FIG. 3).

Referring now to FIG. 3A, as the actuator assembly 60 moves through the first valve sequence, the upper arm 62 begins in contact with the first opener 71. As the control arm 66 moves downward, release or expansion of the first spring 38 holds the first opener 71 against the upper arm 62 until the first seat 30 comes into contact with the inlet 20 of the metering chamber, closing the first spring-biased valve. Once the control arm 66 moves sufficiently so that the upper arm 62 is disengaged from the first opener 71 (as shown in FIG. 3B), the first spring 38 biases the valve 16 into the closed position. During this movement from the first position (FIG. 3A) to the second position (FIG. 3B) of the control arm 66, the lower arm 64 has slid along the second rod 36, partially, but not totally decompressing the second spring 40. Next, in moving from the second position (FIG. 3B) to the third position (FIG. 3C) of the control arm 66, the lower arm 64 slides along the second rod 36 and finally contacts the second opener 72, compressing the second spring 40, and opening the second spring-biased valve 18. The second valve sequence similarly reverses the above steps, introducing a delay between the closing of the second spring-biased valve 18 and the opening of the first spring-biased valve 16.

Seals are used where suitable to prevent flow of the fluid into the area outside the valve assembly 10, the metering chamber 24, and the housing 12. The exact number, shape and placement of such seals depend on the exact configuration of the valve assembly 10 for a specific application. In the preferred embodiment shown, a removable insert 74 is optionally used to surround the rod 34, 36 of each of the spring-biased valves 16, 18 as the rod passes through the housing 12 and contacts actuator assembly 60. O-rings 76, gaskets or similar devices, are preferably used to prevent leakage between the removable insert 74 and the housing 12 or the rods 34, 36. In some applications, it will be preferable for the length of the spring 38, 40 to exceed the dimensions of the upper chamber 54 or the lower chamber 56. When this is desirable, the removable insert 74 includes a hollow compartment 78 that is sized and configured to receive a portion of the length of the spring 38, 40, and to receive the anchored end 42. The removable insert 74 also provides easy access to the spring-biased valves 16, 18 and their component parts when replacements are installed.

Figure 4:
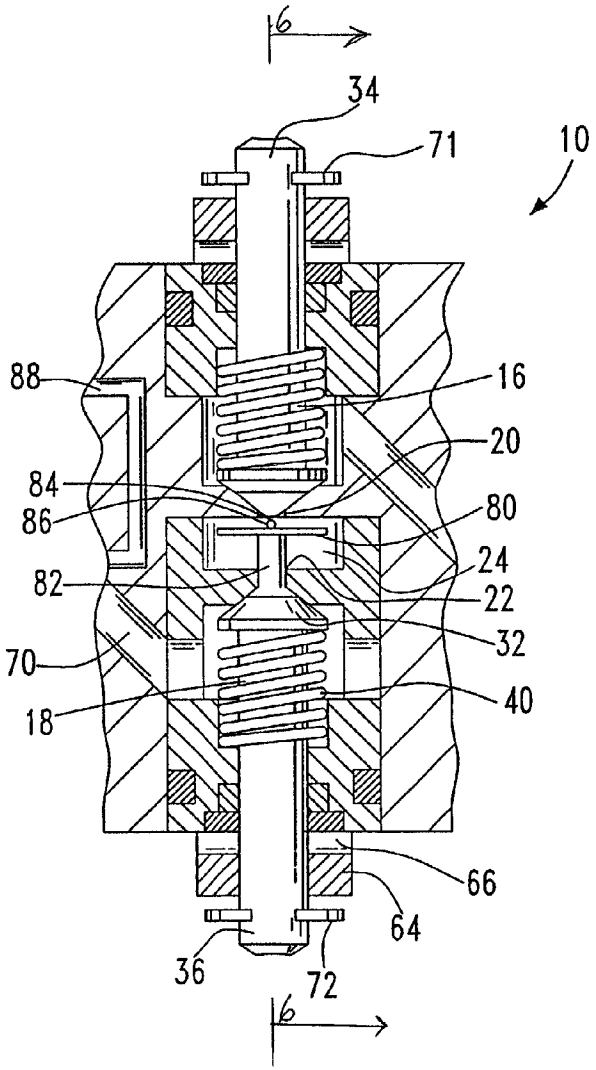
FIG. 4 is a fragmentary sectional view of the present constant volume valve shown equipped with a disk for facilitating the movement of fuel from the metering chamber into the combustion chamber.

Referring now to FIG. 4, it is preferred that the present valve assembly 10 be provided with a mechanism for facilitating the movement or evacuation of fuel from the metering chamber 24 through the outlet 22 and ultimately into the passageway 70 leading to the combustion chamber. As described above, it has been found that when combustion-powered tools of this type are operated at cold temperatures, such as below 32° F., the fuel pressure drops and it becomes more difficult to move the fuel into the combustion chamber. To address this problem, the present valve assembly 10 is preferably provided with a disk 80 secured to the valve 18, specifically at the end of the rod 36 disposed in the metering chamber 24. The disk 80 is preferably located closer to the inlet 20 when the valve 18 is closed. To that end, the disk 80 is secured to a pedestal 82 which in turn is secured to the conical seat 32. In the preferred embodiment, the disk 80 is made of brass or equivalent rigid, heat resistant material, and the petestal 82 is made of rubber or similar resilient polymeric or plastic material. However, other materials are contemplated. Preferably, the disk 80 is friction fit to the pedestal 82 through a frictional mating engagement between a lug 84 on the pedestal and an axial bore 86 in the disk. However, other ways of fastening the disk 80 to the pedestal 82 are contemplated, including but not limited to ultrasonic welding, insert molding, adhesives or other mechanical fasteners. The disk 80 is dimensioned to have a diameter which approximates, but is less than the diameter of the metering chamber 24.

In operation, as the valve 18 opens, as described above in relation to FIG. 3C, the disk 80 moves with the seat 32 from its rest position near the inlet 20 of the metering chamber 24, (best seen in FIG. 4) to a location closer to the outlet 22. This movement will push any residual fuel from the metering chamber 24 through the outlet 22 and ultimately into the passageway 70 leading to the combustion chamber. In this manner, the fuel is mechanically moved from the metering chamber 24. However, since the problem of low fuel pressure is temperature-related, an alternate solution would be to provide a supplemental exhaust passageway 88 through which hot exhaust from the combustion chamber heats up the metering chamber during operation of the tool. An equivalent arrangement is the provision of an electric heating element powered by a resistor or other known arrangement which maintains a satisfactory temperature in the metering chamber 24 to maintain fuel pressure.

Figure 5:
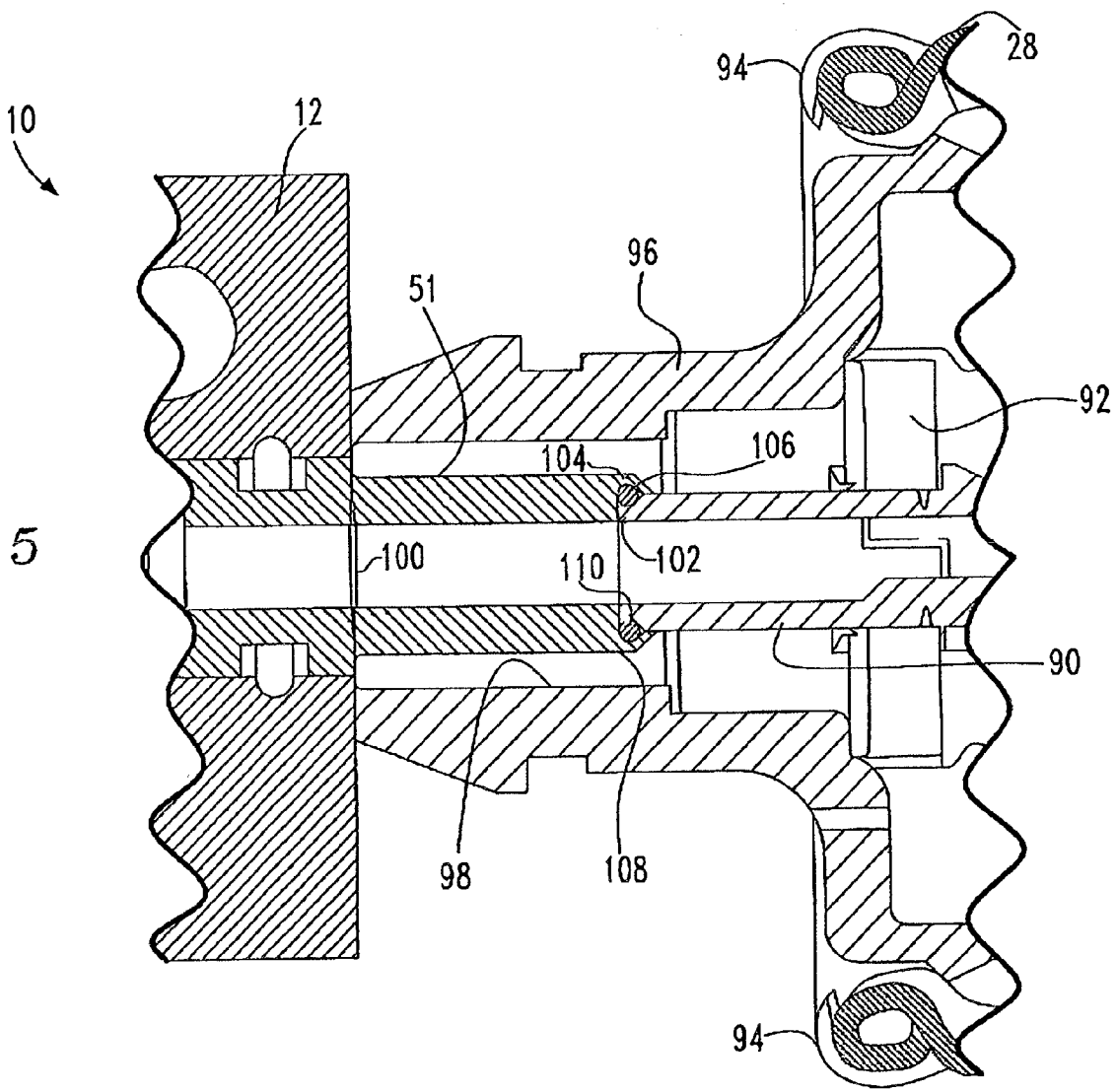
FIG. 5 is a fragmentary sectional view of an alternate embodiment of the present constant volume valve showing the sealing connection between the valve and the interior nozzle of a pressurized fuel cartridge.

Referring now to FIG. 5, the connection between the valve 10 and the fuel canister 28 is shown in greater detail. It is important that a sealing relationship be established between the valve 10 and the fuel canister 28 to prevent loss of fuel, as well as avoid unwanted combustion. The fuel canister 28 is provided with an internal stem 90 which defines an outlet for the fuel contained in the canister under pressure, as is known in the art. As is well known in the art, and exemplified by U.S. Pat. No. 5,115,944 which is incorporated by reference, the stem 90 is secured to, and is circumscribed by an endcap 92 which encloses the end of the canister 28 and forms a rolled seam 94 thereover.

An adapter 96 frictionally engages the endcap 92 and circumscribes and protects the projecting stem 90. An axial passageway 98 is defined by the adapter 96 and accommodates the stem 90. In the preferred embodiment, the adapter also includes a frangible end membrane 100 which blocks the passageway 98, and provides a visible indication of whether or not the canister 28 has been used. The membrane 100 is configured to be pierced upon mating engagement with the nipple 51. Accordingly, the passageway 98 is dimensioned for accommodating the nipple 51.

By the same token, the nipple 51 is preferably generally cylindrical in shape, and has a diameter or cross-sectional parameter dimensioned to slidably and matingly engage the passageway 98, and a length dimensioned to engage an end 102 of the stem 90 to effect fluid communication between the canister 28 and the valve 10. In the preferred embodiment, the nipple 51 is cylindrical, however, other non-circular cross-sectional shapes are contemplated depending on the application, and including oval, square, rectangular and polygonal shapes.

In the preferred embodiment, the nipple 51 and the stem 90 are configured so that, upon operational engagement as depicted in FIG. 5, a sealing relationship is achieved. This relationship, designed to prevent unwanted loss of fuel, may be achieved through frictional contact between the end 102 of the stem 90 and an end 104 of the nipple 51. However, it is preferred that some sort of sealing formation be provided to at least one of the nipple 51 and the stem 90. In the preferred embodiment, the sealing formation is a resilient O-ring 106 provided to the nipple 51. However, other known types of sealing formations are contemplated, including but not limited to ring seals, molded seals and flat washers.

Also, the present nipple end 104 defines a chamber 108 for receiving or capturing a resilient sealing member such as the O-ring 106. More specifically, the end 104 is tapered or chamfered for both retaining the O-ring 106 and also for facilitating insertion of the nipple 51 into the adapter passageway 98. The tapered end 104 more easily pierces the membrane 100, especially when the nipple 51 is fabricated of metal such as brass, which is preferred, however other suitably rigid and durable materials are contemplated.

To further enhance the sealed relationship of the engaged nipple 51 and the stem 90, the end 102 of the stem is configured for matingly engaging or accommodating the O-ring 106. As such, the end 102 is preferably provided with an annular groove 110. Naturally, it is contemplated that the O-ring 106 or other resilient sealing member may be alternately mounted to the stem 90, or that it may be attached to the nipple end 104 by adhesive, in a groove (not shown) or other known type of O-ring attachment technology.

It is also contemplated that, depending on the application, if fluid communication with the canister 28 is required for any reason, a connector may be provided in the form of the nipple 51 which, at the end opposite to the end 104, is in fluid communication with a fluid container or reservoir as desired.

In use, the canister 28 is inserted into the combustion tool so that the nipple 51 matingly engages the adapter 96. The canister 28 is pressed upon the nipple 51 so that the membrane 100 is pierced and the nipple end 104 enters the passageway 98 until contact is made with the stem end 102. As described above, a sealing relationship is preferably obtained, and it is contemplated that other locking apparatus may be employed to secure the canister 28 in this position.

Thus, it will be seen by those skilled in the art that the present valve assembly and metering chamber provide a simple method of providing a constant volume of fluid to a power fastening tool. The two spring-biased valves 16, 18 control the inlet and the outlet to the constant volume metering chamber 24, measuring a constant amount of fluid, independent of in fluctuations in the fluid flow rate. The actuator assembly 60 manipulates opening and closing of the valves 16, 18, receiving the fluid from the pressurized source 28 and metering it before it flows downstream to a combustion or expansion chamber. This arrangement of the valves 16, 18 minimizes wear on the seals, reducing maintenance.

Figure 6:
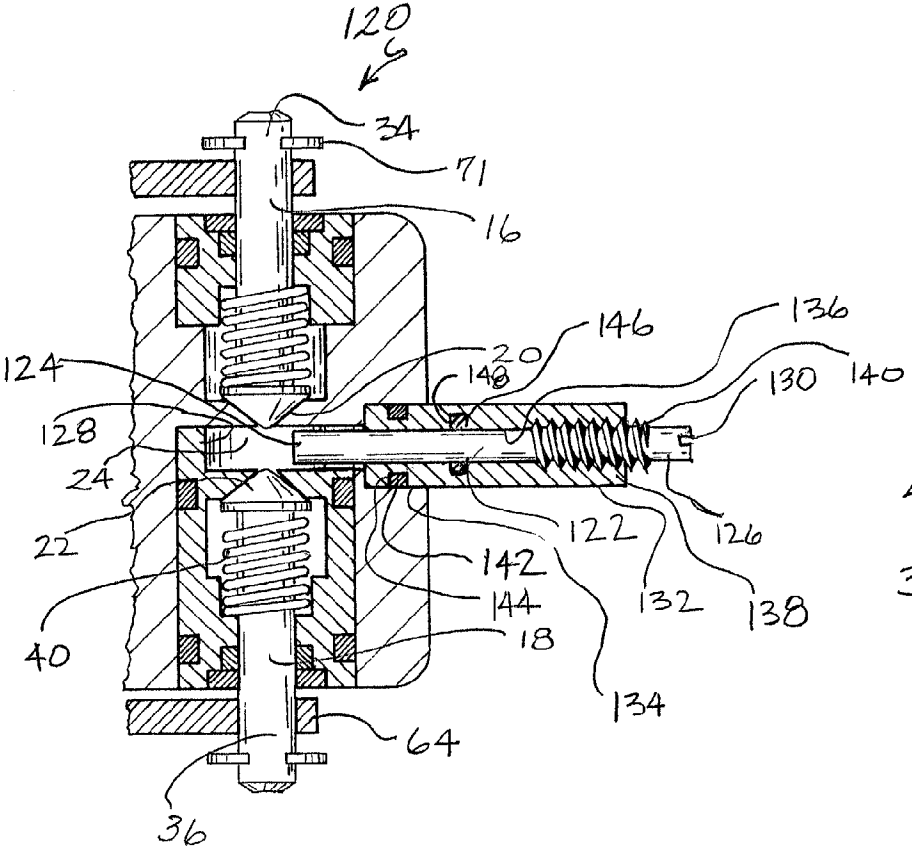
FIG. 6 is a partial cross-section taken along the line 6—6 of FIG. 4 and in the direction indicated generally, and depicts an alternate embodiment of the present valve assembly.

Referring now to FIG. 6, an alternate embodiment of the present valve assembly is generally designated 120. Shared components of the assemblies 10 and 120 are identified with identical reference numbers. The main difference between the assemblies 10 and 120 is that the valve assembly 120 includes a mechanism for varying the volume of the fuel metering chamber 24, so that the user can selectively adjust the volume of fuel sent by the valve assembly to the combustion chamber of the tool. This adjustability is especially useful when the tool is used at higher altitudes or elevations, where the air is thinner and less fuel is needed for efficient combustion.

In the preferred embodiment, the mechanism for varying the volume of the fuel metering chamber is a dosage plunger 122, referred to here as a plunger, which is an elongate member oriented to linearly reciprocate relative to the metering chamber 24. It is preferred that the plunger reciprocates along a longitudinal axis which is generally normal to an axis of operation defined by the valves 16, 18.

The plunger 122 is contemplated as having any configuration which can withstand the operational environment of the combustion tool, and take up space in the metering chamber 24 which would otherwise be taken up by fuel. In the preferred embodiment, the plunger 122 is an elongate metal shaft or rod, having a valve end 124 and an adjustment end 126. As stated previously, the valve end 124 is configured for reducing the volume of the metering chamber 24 by taking up a certain amount of space otherwise occupied by fuel prior to each firing cycle of the tool. As depicted here, the valve end 124 is generally cylindrical in shape with a truncated end, however the end is alternately contemplated as having a complementary shape to a wall 128 of the metering chamber 24.

Opposite the valve end 124, the adjustment end 126 is configured for selective manipulation, here axial rotation, which is accomplished in the preferred embodiment by a screwdriver slot 130. Any conventional shape of driver slot is considered suitable, including but not limited to slotted, Phillips, Tor-x, etc., as well as hex-shaped for an Allen wrench or a conventional socket. Custom-made adjustment configurations are also contemplated for use in applications where only certain qualified service personnel are permitted to adjust the tool.

Between the valve end 124 and the adjustment end 126, the plunger 122 is preferably provided with threads so that the axial reciprocation of the valve end 124 into and out of the metering chamber 24 may be positively controlled. Any equivalent structure for achieving this goal is also contemplated. Also, the plunger 122 is provided with a sufficient length so that adjustment can be made externally of the valve housing 12.

A sleeve 132 is configured for mounting in operational relationship to the valve housing 12 and reciprocally accommodates the plunger 122. More specifically, the sleeve 132 circumscribes and thus supports the plunger 122, and is fixed to the housing 12, preferably by being press-fit into a bore 134. The bore 134 is in communication with the metering chamber 24. Other ways to fix the sleeve 132 to the housing 12 are contemplated, including welding, chemical adhesives and the like. The sleeve 132 is provided with a central, axial throughbore 136 which is in communication with the metering chamber 24 and which is dimensioned to accommodate the plunger 122. To adequately support the plunger 122, the sleeve 132 has a sufficient length, which extends generally normally to the valve housing 12. However, the plunger 122 is preferably longer than the sleeve 132. An outer end 138 of the sleeve 132 is preferably threaded to engage threads 140 of the plunger 122. The specific location of the corresponding threaded portions of the plunger 122 and the sleeve 132 may vary to suit the application.

Since the bore 134, as well as the throughbore 136, are in fluid communication with the metering chamber 24, it is important that they be sealed to prevent the unwanted leakage of fuel. Accordingly, the sleeve 132 is preferably provided with a seal 142 in the form of an O-ring located in a suitably-dimensioned O-ring groove 144. Depending on the application, the groove 144 may be positioned either on the sleeve 132 or in the bore 134. In addition, a plunger seal 146, also preferably an O-ring, seals the throughbore 136 and is disposed in a groove 148, either in the throughbore 136 or the plunger 122.

So that the operation of the valves 16, 18 is not impaired, it is preferred that the plunger 122 be disposed in the metering chamber 24 in an offset position. In other words, the longitudinal axis of the plunger 122 is offset from a vertical plane bisecting the metering chamber 24 in the direction of reciprocal movement of the plunger. Practically speaking, and referring now to FIG. 6, the plunger 122 is located behind the axis of movement of the valves 16, 18.

Figure 7:
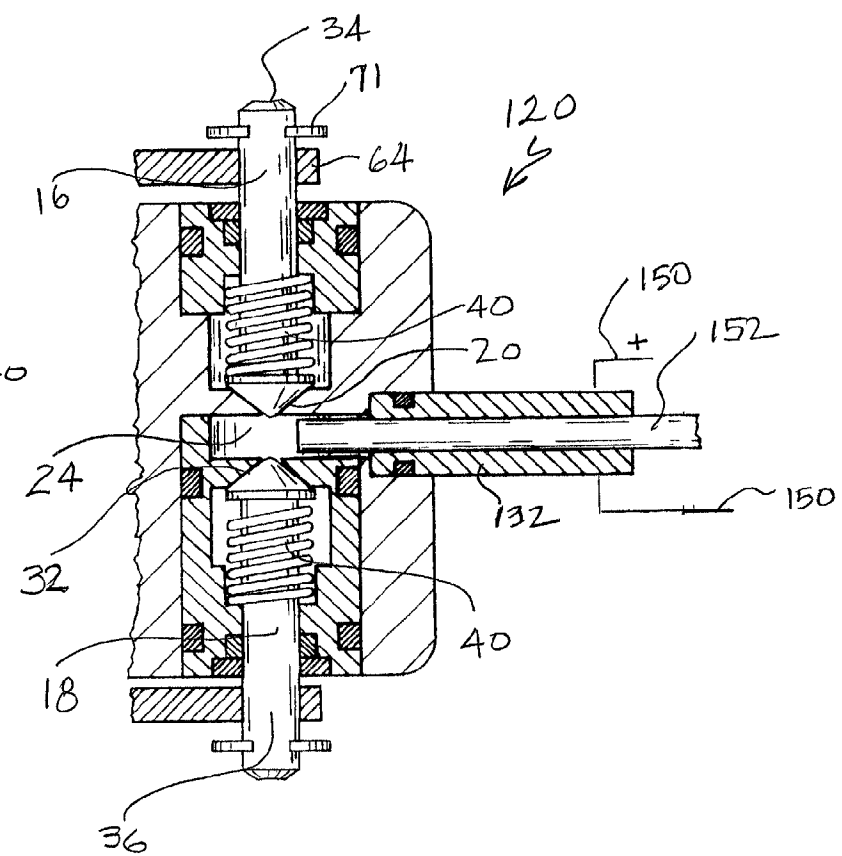
FIG. 7 is an alternate embodiment of the valve assembly depicted in FIG. 6, in which the metering adjustment shaft is replaced with a heating element.

Referring now to FIG. 7, another feature of the present system 120 is that the plunger 122 or the sleeve 132 is heated so that the tool can be used in relatively low temperatures (below 32° F.) when the fuel pressure decreases as described above. The heat can be provided electrically by connecting live leads 150 powered by the battery (not shown) of the tool.

Alternately, replacing the plunger 122 with a stationary heating element 152 can provide heat. The heating element 152 may be reciprocated within the sleeve 132 through a friction fit, and is also contemplated as being connectable to the battery as is well known in the art. As described above in relation to the supplemental exhaust passageway 88 (FIG. 4), additional heat can be provided from the combustion chamber.

While a particular embodiment of the constant volume valve assembly and metering chamber has been shown and described, it will be appreciated by those skilled in the art that changes and modifications may be made thereto without departing from the invention in its broader aspects and as set forth in the following claims.

What is claimed is:

1. A variable volume metering chamber and valve assembly for use with a combustion-powered tool, said assembly comprising:

a housing defining a metering chamber having an internal volume and including an inlet and an outlet; and means for manually adjusting the internal volume of said metering chamber, said means including a plunger configured for adjustable reciprocation relative to said metering chamber, and a sleeve configured for mounting in operational relationship to said housing and to reciprocally accommodate said plunger;

said means for manually adjusting being accessible externally of said housing for enabling a user to adjust tool performance during operation to accommodate environmental variations.

2. The valve assembly of claim 1 wherein said plunger is located partially within said metering chamber and partially external to said metering chamber.

3. The valve assembly of claim 1 wherein at least a portion of said sleeve and said plunger are threadably engaged relative to each other to adjust the amount of insertion of said plunger into said metering chamber.

4. The valve assembly of claim 1 further including a seal for sealing at least one of said plunger and said sleeve relative to said metering chamber.

5. A variable volume fuel-metering chamber and valve assembly for use with a combustion-powered tool, said assembly comprising:

a housing defining a metering chamber having an internal volume and including an inlet and an outlet;

a plunger configured for reciprocal movement relative to said chamber for adjusting the internal volume of said metering chamber to determine the amount of fuel metered, and upon adjustment, a position of said plunger relative to said chamber remains constant until a subsequent adjustment, and is independent of tool and; and a sleeve configured for mounting in operational relationship to said housing and to reciprocally accommodate said plunger;

wherein said plunger is accessible externally of said housing for enabling a user to adjust tool performance during operation to accommodate environmental variations.

6. The valve assembly of claim 5 wherein at least a portion of said sleeve and said plunger are threadably engaged relative to each other to adjust the amount of insertion of said plunger into said metering chamber.

7. The valve assembly of claim 5 further including a seal for sealing at least one of said plunger and said sleeve relative to said metering chamber.

8. The valve assembly of claim 5 wherein said valve has an axis of operation, and wherein said plunger is reciprocal along an axis which is generally normal to said axis of operation.

9. The valve assembly of claim 5 wherein said plunger is offset from a vertical plane bisecting said chamber in the direction of reciprocal movement of said plunger.

10. The valve assembly of claim 5 wherein said sleeve is heated.

11. The valve assembly of claim 5 further including:

a first spring-biased valve disposed in said housing to control fluid flow through said inlet;

a second spring-biased valve disposed in said housing to control fluid flow through said outlet;

an actuator assembly, connected to said first and second spring-biased valves and sequentially operable from a first position, in which said first spring-biased valve is open and said second spring-biased valve is closed, to a second position, in which said first and second spring-biased valves are both closed, and a third position, in which said first spring-biased valve is closed and said second spring-biased valve is open; and said valve assembly being configured and arranged so that a volume of fluid entering said chamber from said inlet in said first position is collected in said metering chamber, sealed within said metering chamber in said second position, and released from said metering chamber in said third position to provide a constant volume of fluid for each sequential movement of said actuator from said first position to said third position.

12. A variable volume metering chamber and valve assembly for use with a pressurized fluid supply containing a fluid in a combustion-powered tool, said assembly comprising:

a housing defining a metering chamber having a plurality of ports including an inlet and an outlet;

a first spring-biased valve disposed in said housing to control fluid flow through said inlet;

a second spring-biased valve disposed in said housing to control fluid flow through said outlet;

an actuator assembly, connected to said first and second spring-biased valves and sequentially operable from a first position, in which said first spring-biased valve is open and said second spring-biased valve is closed, to a second position, in which said first and second spring-biased valves are both closed, and a third position, in which said first spring-biased valve is closed and said second spring-biased valve is open;

said valve assembly being configured and arranged so that a volume of fluid entering said chamber from said inlet in said first position is collected in said metering chamber, sealed within said metering chamber in said second position, and released from said metering chamber in said third position to provide a constant volume of fluid for each sequential movement of said actuator from said first position to said third position; and a heater provided in operational relationship to said housing for heating said metering chamber.

13. The valve assembly of claim 12, wherein said heater is a heating element fixed to said housing adjacent said metering chamber.

* * * * *